US006891507B2

(12) United States Patent
Kushihi et al.

(10) Patent No.: US 6,891,507 B2
(45) Date of Patent: May 10, 2005

(54) SURFACE MOUNT ANTENNA, METHOD OF MANUFACTURING SAME, AND COMMUNICATION DEVICE

(75) Inventors: Yuichi Kushihi, Kanazawa (JP); Minoru Yamaguchi, Sabae (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 11 days.

(21) Appl. No.: 10/681,982

(22) Filed: Oct. 9, 2003

(65) Prior Publication Data

US 2004/0090382 A1 May 13, 2004

(30) Foreign Application Priority Data

Nov. 13, 2002 (JP) ..... 2002-329341

(51) Int. Cl.[7] ..... H01Q 1/24; H01Q 1/38

(52) U.S. Cl. ..... 343/702; 343/700 MS; 29/600

(58) Field of Search ..... 343/700 MS, 702, 343/829, 846; 29/600

(56) References Cited

U.S. PATENT DOCUMENTS 6,323,811 B1 * 11/2001 Tsubaki et al. ..... 343/700 MS 6,753,813 B2 * 6/2004 Kushihi ..... 343/700 MS

FOREIGN PATENT DOCUMENTS

| | | |
|---|---|---|
| JP | 08-018329 | 1/1996 |
| JP | 2001-119224 | 4/2001 |
| JP | 2003-037421 | 2/2003 |

* cited by examiner

*Primary Examiner*—Michael C. Wimer
(74) *Attorney, Agent, or Firm*—Keating & Bennett, LLP

(57) ABSTRACT

A surface mount antenna includes a conductive film provided on four continuous surfaces, that is, a front end surface, a top surface, a rear end surface, and a bottom surface, of a dielectric substrate. A plurality of slits is formed in the conductive film so as to divide the conductive film into a plurality of conductive film parts. At least one of the divided conductive film parts functions as a radiation electrode. Sides of one of the slits, that is, the slit forming an open end of the radiation electrode, are formed by a dicer. The position of the open end of the radiation electrode affects the resonance frequency of the radiation electrode. Since the dicer can cut with high precision, the open end can be provided substantially at a desired position, whereby the radiation electrode can generate a substantially the desired resonance frequency.

32 Claims, 15 Drawing Sheets

SURFACE MOUNT ANTENNA, METHOD OF MANUFACTURING SAME, AND COMMUNICATION DEVICE

BACKGROUND OF THE INVENTION

1. Field of the Invention

The present invention relates to a surface mount antenna that can be mounted on a circuit substrate, a method of manufacturing the same, and a communication device.

2. Description of the Related Art

Surface mount antennas that can be mounted on a circuit substrate have been used in the past. These surface mount antennas include, for example, a dielectric substrate in chip form and at least one radiation electrode operating as an antenna, the radiation electrode being disposed on the dielectric substrate. Two known methods of manufacturing surface mount antennas are described below. According to one method, an electrode is formed on the surface of the dielectric substrate by plating or the like. Then, this electrode is subjected to etching, whereby the radiation electrode is formed. According to the other method, a thick-film paste is formed on the surface of a dielectric substrate by printing so as to have the form of the radiation electrode. Then, the thick-film paste is dried and fired, whereby the surface mount antenna is formed.

The above-described techniques are disclosed in Japanese Unexamined Patent Application Publication Nos. 2001-119224 and 8-18329.

In general, the known surface mount antennas have a small substrate. However, the radiation electrodes are individually formed on the small substrates. Since it is difficult to form the radiation electrodes on the small substrates, the efficiency of manufacturing the surface mount antennas reduces and the cost thereof increases.

The dielectric constants and sizes of the dielectric substrates often vary slightly, which often causes variations in resonance frequencies of the radiation electrodes on the dielectric substrates. Therefore, the dimensions of the radiation electrodes must be adjusted with high precision to reduce these variations, considering the dielectric constants and the sizes thereof. However, since the radiation electrodes are small, it has been difficult to form the radiation electrodes to have precise dimensions.

Further, the form and dimensions of the radiation electrode and the dimensions of the dielectric substrate or other elements must be redesigned to change the resonance frequency of the radiation electrode, which requires much time and effort.

SUMMARY OF THE INVENTION

In order to overcome the problems described above, preferred embodiments of the present invention provide a surface mount antenna having at least one radiation electrode that can generate substantially the desired resonance frequency with ease. This surface mount antenna is formed so that the design thereof can be changed with ease and speed. In addition, preferred embodiments of the present invention provide a method of manufacturing the surface mount antenna with efficiency and a communication device including the surface mount antenna.

According to a first preferred embodiment of the present invention, a surface mount antenna functions as a capacitive-feed surface mount antenna including a radiation electrode and a feed-terminal electrode. This surface mount antenna includes a substrate and a conductive film provided on four continuous surfaces of the substrate. These four continuous surfaces include a front end surface, a top surface, a rear end surface, and a bottom surface. A plurality of slits with predetermined spacing is formed on the conductive film. The plurality of slits extends over the width of the substrate in a predetermined direction crossing the direction in which the four continuous surfaces surround the substrate and divides the conductive film into a plurality of conductive film parts. One of the plurality of conductive film parts functions as the radiation electrode, which operates as an antenna, and one of the other conductive film parts functions as the feed-terminal electrode, which is capacitively coupled to the radiation electrode. At least one of the plurality of slits is formed between the radiation electrode and the feed-terminal electrode and functions as a capacitance coupling element for capacitively coupling the radiation electrode to the feed-terminal electrode. A ratio between and/or among capacitances generated by the plurality of slits is used for matching a first impedance of the radiation electrode to a second impedance of the feed-terminal electrode. The at least one slit forming the capacitance portion forms an open end of the radiation electrode and sides of the slit forming the open end are formed by using a dicer.

Since the precision of processing performed by the dicer is high, the sides of the slit forming the open end of the radiation electrode are formed by the dicer. Subsequently, the open end can be formed at a substantially predetermined position. Since the position of the open end significantly affects the resonance frequency of the radiation electrode, it becomes possible to make the radiation electrode generate substantially the predetermined resonance frequency by forming the open end at the substantially predetermined position.

Therefore, it becomes unnecessary to adjust the resonance frequency of the radiation electrode after the radiation electrode is formed, whereby the efficiency of manufacturing the surface mount antenna increases.

Further, it becomes possible to form various types of surface mount antennas, that is, the capacitive-feed surface mount antenna, the direct-feed surface mount antenna, and the surface mount antenna having the capacitive-feed radiation electrode and the direct-feed radiation electrode by changing the position of each of the plurality of slits.

Further, according to preferred embodiments of the present invention, surface mount antennas with various antenna characteristics can be easily designed only by variably determining the number of the slits and the position and width of each of the slits. Therefore, the design of the surface mount antenna of preferred embodiments of the present invention can be changed with ease and speed.

Where the capacitive-feed surface mount antenna is formed, the impedance of the surface mount antenna can be matched to that of the circuit of the communication device to which the capacitive-feed surface mount antenna is connected by adjusting the ratio between and/or among the capacitances of the slits. In preferred embodiments of the present invention, this ratio can be used for achieving the impedance matching. Therefore, where this capacitive-feed surface mount antenna is mounted on the communication device, it is not necessary to provide an external matching circuit for achieving the impedance matching on a signal-flow path connecting the capacitive-feed surface mount antenna to the circuit of the communication device. Consequently, the circuit configuration of preferred embodiments of the present invention is simplified.

Thus, the impedance matching can be easily achieved only by using the ratio between and/or among the capacitances of the slits without using the external matching circuit. The impedance matching characteristic of this surface mount antenna affects the bandwidth of the radiation electrode. Therefore, since this characteristic becomes high, the bandwidth of the radiation electrode increases.

According to another preferred embodiment of the present invention, a method of manufacturing a surface mount antenna including at least one radiation electrode and at least one feed-terminal electrode that are formed of a conductive film and that are formed on a substrate includes the steps of forming the conductive film on four continuous surfaces of a base including a top surface, a bottom surface, and two end surfaces facing each other, forming a plurality of slits in the conductive film by cutting the conductive film by using a dicer so that the slits extend in a direction crossing the direction in which the conductive film surrounds the base, and dividing the base along the surrounding direction into a plurality of pieces so as to form a plurality of the surface mount antennas.

According to the method of manufacturing the surface mount antenna of a preferred embodiment of the present invention, the conductive film is formed on the base, that is, the base material of the substrate of the surface mount antenna. After the slits are formed in the conductive film and the base, the base is cut and divided so that the plurality of the surface mount antennas is formed at the same time. Therefore, the manufacturing efficiency of the present invention is significantly higher than that in the case where the radiation electrode is formed on each of the small substrates. That is to say, it becomes possible to easily reduce the cost of manufacturing the surface mount antenna.

The base is cut and divided preferably by using the same dicer as the one used for forming the slits. Therefore, a series of manufacturing procedures from the slit forming to the base cutting can be performed in sequence by using the same dicer, which further increases the efficiency of manufacturing the surface mount antennas.

Where the slits are formed on at least two of the four continuous conductive film parts, at least one of the slits is formed on at least one of the conductive film parts without using the dicer. Then, the other slits are formed on the other conductive film parts by using the dicer.

Where the slits are formed by using the dicer, the base must be turned and/or reversed every time one surface of the base, the surface being subjected to the slit forming process, is switched over to another surface so that the base is positioned such that surface being subjected to the slit forming process is facing upwardly. Since this remounting process is complicated, the manufacturing efficiency of the surface mount antenna decreases when the number of the surfaces subjected to the slit forming process is high. However, in preferred embodiments of the present invention, at least one of the slits is formed on at least one of the conductive films without using the dicer, which reduces the remounting process. Further, since the slit forming the open end of the radiation electrode is formed with precision by using the dicer, the radiation electrode can generate substantially the desired resonance frequency.

According to another preferred embodiment of the present invention, a communication device includes the above-described surface mount antenna, or a surface mount antenna formed according to the above-described manufacturing method.

Since the surface mount antenna of the communication device can generate substantially the desired resonance frequency and has the wide bandwidth, the reliability of this communication device is greatly increased.

If it is difficult to match the impedance of the surface mount antenna to that of the circuit of the communication device, the matching circuit may be provided on the signal-flow path between the surface mount antenna and the circuit for achieving the impedance matching, whereby the sensitivity of the communication device increases.

Other features, elements, characteristics and advantages of the present invention will become more apparent from the following detailed description of preferred embodiments with reference to the attached drawings.

DETAILED DESCRIPTION OF PREFERRED EMBODIMENTS

Preferred embodiments of the present invention will now be described with reference to the attached drawings.

Figure 1:
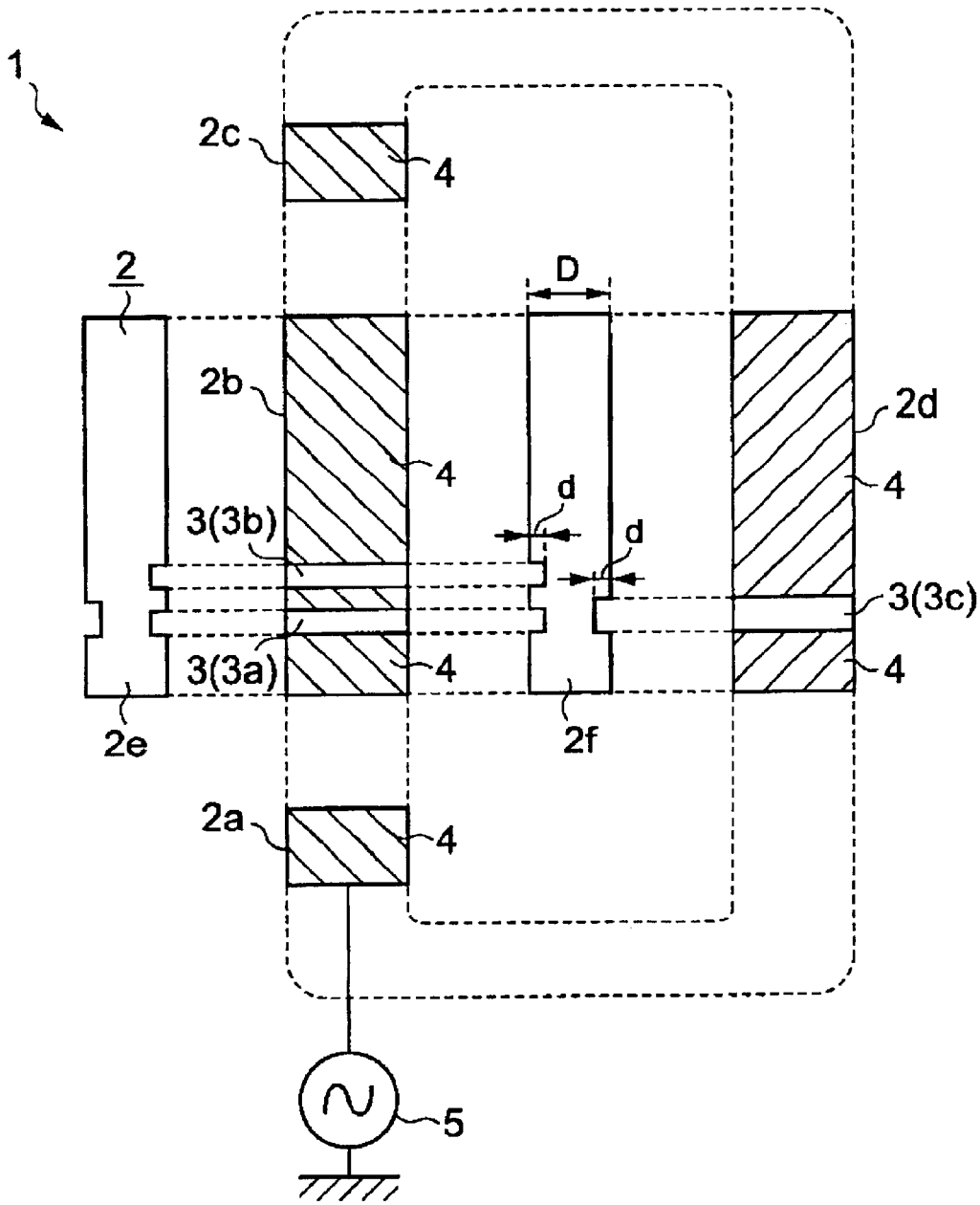
FIG. 1 is a development view of a surface mount antenna according to a first preferred embodiment of the present invention.
Figure 2A:
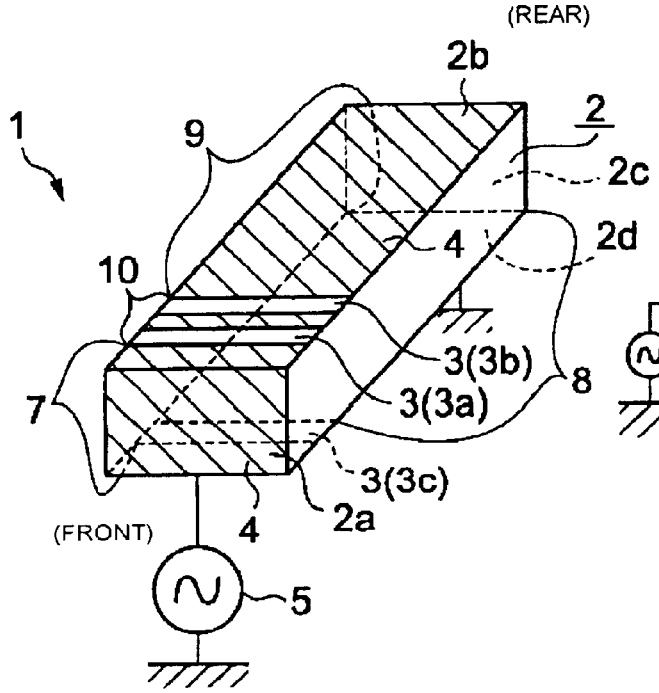
FIG. 2A shows the surface mount antenna shown in FIG. 1 mounted on a circuit substrate of a communication device by a ground mounting method.

FIG. 1 is a development view of a surface mount antenna 1 according to a first preferred embodiment of the present invention. FIG. 2A is a schematic perspective view of this surface mount antenna 1 including a substantially rectangular dielectric substrate 2. This dielectric substrate 2 has four continuous surfaces, that is, a front end surface 2*a*, a top surface 2*b*, a rear end surface 2*c*, and a bottom surface 2*d*, and a conductive film 4 that is disposed on these surfaces and that is separated into a plurality of conductive film parts by a plurality of slits 3*a*, 3*b*, and 3*c*.

These slits 3*a*, 3*b*, and 3*c* extend over the width of the dielectric substrate 2 in a direction crossing the direction in which the front end surface 2*a*, the top surface 2*b*, the rear end surface 2*c*, and the bottom surface 2*d* surround the substrate 2 in this order. In this preferred embodiment, these slits 3*a*, 3*b*, and 3*c* extend in a direction that is substantially perpendicular to the surrounding direction. The width of each of these slits is the same as the width of the dielectric substrate 2. The slits 3*a* and 3*b* are formed on the top face 2*b* with a predetermined gap therebetween and the slit 3*c* is formed on the under face 2*d*.

These slits 3*a*, 3*b*, and 3*c* are formed preferably by using a dicer. The depth d of each of these slits is preferably from about 1/2000 to about 3/4 of the thickness of the surface mount antenna 1, the thickness being designated by D; that is, $((D/2000) \leqq d \leqq (3 \cdot D/4))$. Under this condition, the depths of these slits 3*a*, 3*b*, and 3*c* may be the same as or different from one another. Further, the slit 3*a* may be formed so that the depth D thereof is the same as that of the slit 3*b* and that of the slit 3*c* is different from those of the slits 3*a* and 3*b*. That is to say, the widths of only two of these slits 3*a*, 3*b*, and 3*c* may be the same as each other.

A capacitance Ca is generated in the slit 3*a* separating the conductive film 4 formed on the top surface 2*b*. That is to say, the capacitance Ca is generated between the sides of the slit 3*a* separating the conductive film 4. A capacitance Cb is generated in the slit 3*b* that also separates the conductive film 4 on the top surface 2*b*. That is to say, the capacitance Cb is generated between the sides of the slit 3*b* separating the conductive film 4. The sum of the capacitance Ca and the capacitance Cb is designated as a capacitance Ct (Ct=Ca+Cb). A capacitance Cc is generated in the slit 3*c* separating the conductive film 4 formed on the bottom surface 2*d*. That is to say, the capacitance Cc is generated between the sides of the slit 3*c* separating the conductive film 4. The ratio between the capacitance Ct and the capacitance Cc is designated by Sc (Sc=Cc/Ct). The numerical value of this ratio Sc is from about 0.1 to about 10 (about $0.1 \leqq Sc \leqq$ about 10).

The above-described surface mount antenna 1 is mounted on a circuit substrate of a communication device and connected to a circuit such as an RF circuit 5 that is disposed on the circuit substrate and used for communication. The surface mount antenna 1 can be mounted on the circuit substrate by either a ground mounting method or a non-ground mounting method.

If the surface mount antenna 1 is mounted on the circuit substrate according to the ground mounting method, a conductive film part 7 extending from the slit 3*c* on the bottom surface 2*d* to the slit 3*a* on the top surface 2*b* via the front end surface 2*a* is connected to the RF circuit 5 disposed on the circuit substrate, as shown in FIG. 2A. A conductive film part 8 formed on the bottom surface 2*d* at the rear of the slit 3*c* is connected to the ground of the circuit substrate.

In this case, the conductive film part 7 functions as a feed-terminal electrode and the conductive film part 8 functions as a ground electrode. A conductive film part 9 on the dielectric substrate 2 extending from the slit 3*b* on the top surface 2*b* to a base end of the rear end surface 2*c* functions as a radiation electrode. The slits 3*a* and 3*b* formed between the feed-terminal electrode 7 and the radiation electrode 9 form a capacitance coupling element 10 for capacitively coupling the feed-terminal electrode 7 to the radiation electrode 9. That is to say, this surface mount antenna 1 is a capacitive-feed surface mount antenna.

If the surface mount antenna 1 is mounted on the circuit substrate according to the ground mounting method as described above, one end of the radiation electrode 9 is connected to the RF circuit 5 via the capacitance coupling element 10. The other end of the radiation electrode 9 is connected to ground, as shown in an equivalent circuit diagram shown in FIG. 2B. In this case, the radiation electrode 9 produces resonance as a $\lambda/4$ antenna.

The effective length of the radiation electrode 9, the effective length being indicated by L, affects the resonance frequency of the radiation electrode 9. The effective length L is the length from the one end to the other end of the radiation electrode 9. If the surface mount antenna 1 is mounted on the circuit substrate by the ground mounting method, the other end of the radiation electrode 9, which is connected to ground, is fixed at the base end of the rear end surface 2*c*. Although the position of the other end connected to ground cannot be changed, the position of the slit 3*b* is variably determined, whereby the position of an open end of the radiation electrode 9 can be modified. Therefore, it becomes possible to change the effective length L of the radiation electrode 9. In this case, the electrical length of the radiation electrode 9 becomes variable and the resonance frequency of the radiation electrode 9 also becomes variable. That is to say, it becomes possible to variably control the resonance frequency of the radiation electrode 9 by changing the position of the slit 3*b*. Considering these facts, the position of the slit 3*b* is determined by experiment, simulation, and so forth, so as to obtain a predetermined resonance frequency of the radiation electrode 9.

The balance among the capacitances Ca, Cb, and Cc generated in the slits 3*a*, 3*b*, and 3*c* affects the impedance matching between the radiation electrode 9 and the RF circuit 5 provided outside. Therefore, the width of each of the slits 3*a*, 3*b*, and 3*c* is determined by experiment, simulation, and so forth, so that the ratio among the capacitances Ca, Cb, and Cc becomes a capacitance ratio suitable for matching the impedance of the radiation electrode 9 to that of the RF circuit 5.

In this preferred embodiment, the sum of the widths of the slits 3*a*, 3*b*, and 3*c* is indicated by H. In this case, the slit width H is preferably from about 1/1000 to about 3/4 of the effective length L. That is to say, the ratio between the effective length L and the slit width H is $(1/1000) \leqq (H/L) \leqq (3/4)$. Under these conditions, the width of each of the slits 3*a*, 3*b*, and 3*c* is determined.

Figure 3A:
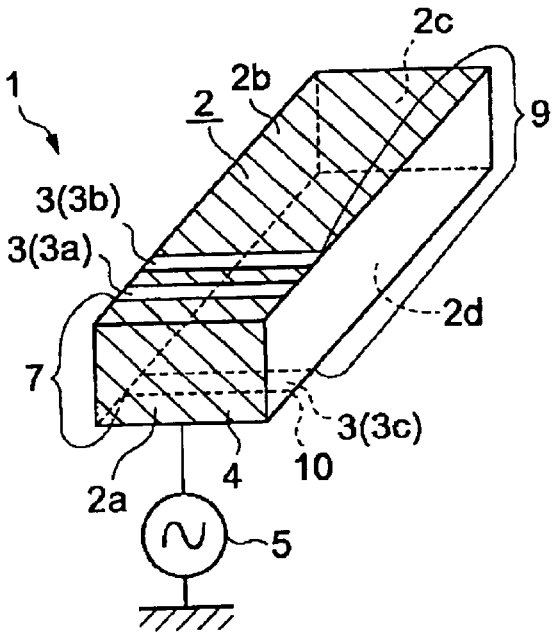
FIG. 3A shows the surface mount antenna shown in FIG. 1 mounted on the circuit substrate by a non-ground mounting method.

FIG. 3A is a perspective view of the surface mount antenna 1 of FIG. 1 mounted on the circuit substrate by the non-ground mounting method. In this case, the conductive film part 7 extending from the slit 3*c* on the bottom surface 2*d* to the slit 3*a* on the top surface 2*b* via the front end surface 2*a* is connected to the RF circuit 5 on the circuit substrate. Further, a conductive film part 9 extending from the slit 3*c* to the slit 3*b* on the top surface 2*b* via the rear end surface 2*c* does not come into contact with ground.

In this case, the conductive film part 7 functions as a feed-terminal electrode and the conductive film part 9 functions as a radiation electrode. The slit 3*c* formed between the feed-terminal electrode 7 and the radiation electrode 9 forms a capacitance coupling element 10 for capacitively coupling the feed-terminal electrode 7 to the radiation electrode 9. That is to say, this surface mount antenna 1 also functions as a capacitive-feed surface mount antenna, as in the case where the ground mounting method is used.

Figure 3B:
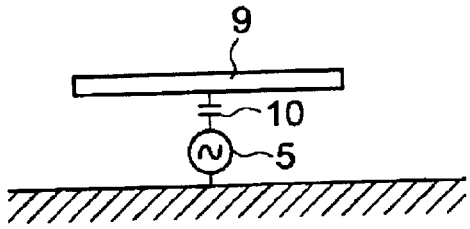
FIG. 3B is an equivalent circuit diagram of the surface mount antenna shown in FIG. 3A.

In the case where the surface mount antenna 1 shown in FIG. 1 is mounted on the circuit substrate of the communication device according to the non-ground mounting method, the radiation electrode 9 is connected to the RF circuit 5 via the capacitance coupling element 10. Both ends of the radiation electrode 9 are open, as shown in an equivalent circuit diagram of FIG. 3B. Subsequently, this surface mount antenna 1 functions as a $\lambda/2$ antenna.

Both ends of this radiation electrode 9 are open due to the slits 3*b* and 3*c* provided at these ends. The effective length or electrical length of the radiation electrode 9 can be variably controlled by changing the positions of the slits 3*b* and 3*c*. It should be noted that the electrical length determines the resonance frequency of the radiation electrode 9. According to these circumstances, the positions of the slits 3*b* and 3*c* are determined so as to obtain a predetermined resonance frequency of the radiation electrode 9.

As in the case of the ground mounting method, the width of each of the slits 3*a*, 3*b*, and 3*c* is determined so that the ratio among the capacitances Ca, Cb, and Cc becomes a capacitance ratio suitable for matching the impedance of the radiation electrode 9 to that of the external RF circuit 5.

Example procedures for manufacturing the surface mount antenna 1 of this preferred embodiment will now be described with reference to FIGS. 4A, 4B, 4C, 4D, and 4E.

Figure 4A:
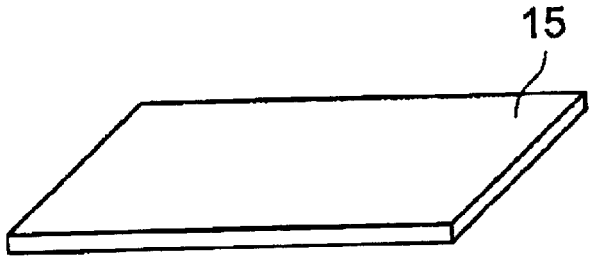
FIG. 4A shows an example procedure of manufacturing the surface mount antenna shown in FIG. 1.
Figure 4B:
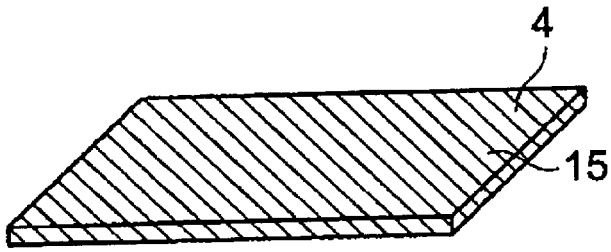
FIG. 4B shows another example procedure of manufacturing the surface mount antenna shown in FIG. 1.

First, a dielectric base 15 shown in FIG. 4A is prepared. This dielectric base 15 is formed large enough to cut a plurality of the dielectric substrates 2 therefrom. Then, the conductive film 4 is formed on the entire surface of the dielectric base 15, as shown in FIG. 4B, by a film-forming technology such as plating, a thick-film printing technology, or other suitable process, and so forth.

Figure 4C:
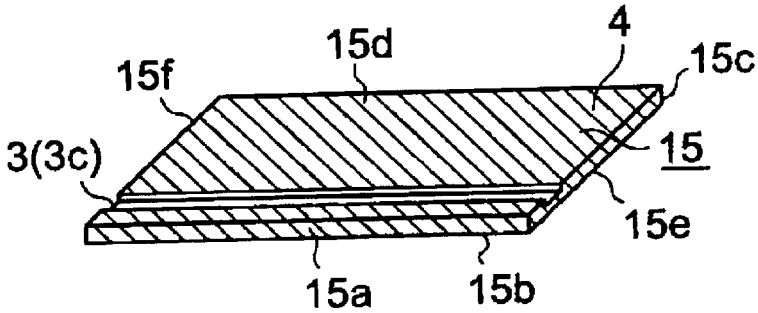
FIG. 4C shows another example procedure of manufacturing the surface mount antenna shown in FIG. 1.

Then, the slit 3*c* is formed at a predetermined position on a bottom surface 15*d* of the dielectric base 15 by using the dicer, as shown in FIG. 4C. This slit 3*c* extends in a direction crossing the direction in which a front end surface 15*a*, a top surface 15*b*, a rear end surface 15*c*, and the bottom surface 15*d* surround the dielectric base 15 in this order. In this preferred embodiment, this slit 3*c* is preferably formed so as to be substantially perpendicular to the above-described surrounding direction. Further, this slit 3*c* is formed so as to extend from a side surface 15*e* to an opposite side surface 15*f* and have a substantially constant width.

Figure 4D:
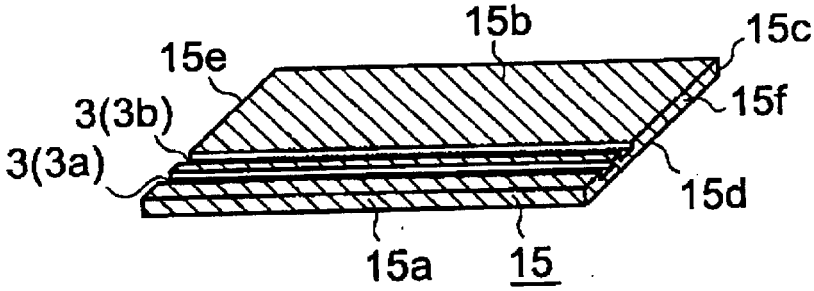
FIG. 4D shows another example procedure of manufacturing the surface mount antenna shown in FIG. 1.

Then, the dielectric base 15 is reversed, and the slits 3*a* and 3*b* are formed at predetermined positions on the top surface 15*b* by using the dicer, as shown in FIG. 4D. As in the case of the slit 3*c* on the bottom surface 15*d*, these slits 3*a* and 3*b* extend in a direction crossing the direction in which the front end surface 15*a*, the top surface 15*b*, the rear end surface 15*c*, and the bottom surface 15*d* surround the dielectric base 15. In this preferred embodiment, these slits 3*a* and 3*b* are preferably formed so as to be substantially perpendicular to this surrounding direction. Further, each of these slits 3*a* and 3*b* is formed so as to extend from the side surface 15*e* to the opposite side surface 15*f* and have a substantially constant width.

Figure 4E:
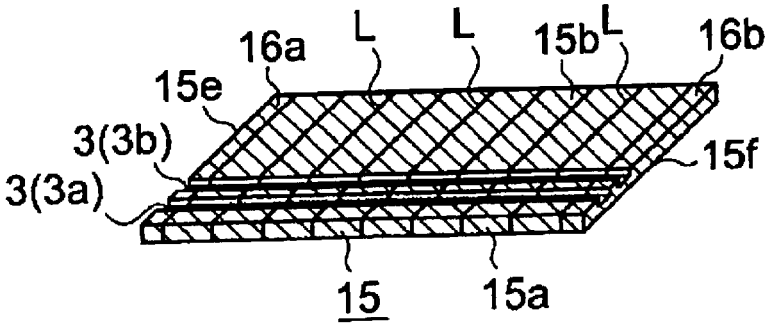
FIG. 4E shows another example procedure of manufacturing the surface mount antenna shown in FIG. 1.

Then, the dielectric base 15 is cut and divided into a plurality of pieces by the dicer. The dielectric base 15 is cut along cut lines L extending along the surrounding direction, as shown in FIG. 4E. Subsequently, a plurality of the surface mount antennas 1 shown in FIGS. 2A and 3A is formed. In this procedure, an end portion 16*a* near the side surface 15*e* and an end portion 16*b* near the side surface 15*f* are cut and removed. At this time, therefore, both side surfaces of the dielectric base 15 are not covered with the conductive film 4.

As has been described, the conductive film 4 is formed on the entire surface of the dielectric base 15. That is to say, the conductive film 4 is formed on a parent base, that is, a base material of the dielectric substrate 2. Then, the slits 3*a*, 3*b*, and 3*c* are formed on the dielectric base 15, and the plurality of the surface mount antennas 1 is cut from the dielectric base 15 at the same time. Subsequently, the manufacturing efficiency becomes higher than that in the case where the plurality of the small surface mount antennas 1 is individually formed.

Since the procedure for forming the slits 3*a* and 3*b* on the top surface 15*b* and the following procedure for cutting the dielectric base 15 are performed by the same dicer, these procedures can be performed in sequence. Subsequently, the time required for manufacturing the surface mount antenna 1 is reduced and the manufacturing efficiency increases.

According to the configuration of this surface mount antenna 1 of this preferred embodiment, the resonance frequency (the electrical length) of the radiation electrode 9 is variable due to the slits 3*a*, 3*b*, and 3*c* whose positions are variably determined. Therefore, if the design of the surface mount antenna 1 is changed, the resonance frequency of the radiation electrode 9 can be changed with ease and speed.

In this preferred embodiment, the slits 3*a*, 3*b*, and 3*c* are formed to precise dimensions by using the dicer, which can cut with high precision. Therefore, the open ends of the radiation electrode 9, the open ends being formed by the slits 3*b* and 3*c*, can be provided at substantially the desired positions. Subsequently, the radiation electrode 9 can generate substantially the desired resonance frequency.

Although three slits are formed according to this preferred embodiment, as shown in FIG. 1, the number of the slits is not limited to this preferred embodiment, and can be two or more. That is to say, a necessary number of slits can be formed, considering the resonance frequency of the radiation electrode 9 and the impedance matching. Further, the slits can be formed at positions different from those of the first preferred embodiment, considering a predetermined resonance frequency of the radiation electrode 9. A modification example of the first preferred embodiment will be described. In this modification, a different number of slits are formed on the conductive film 4 at different positions.

Figure 5:
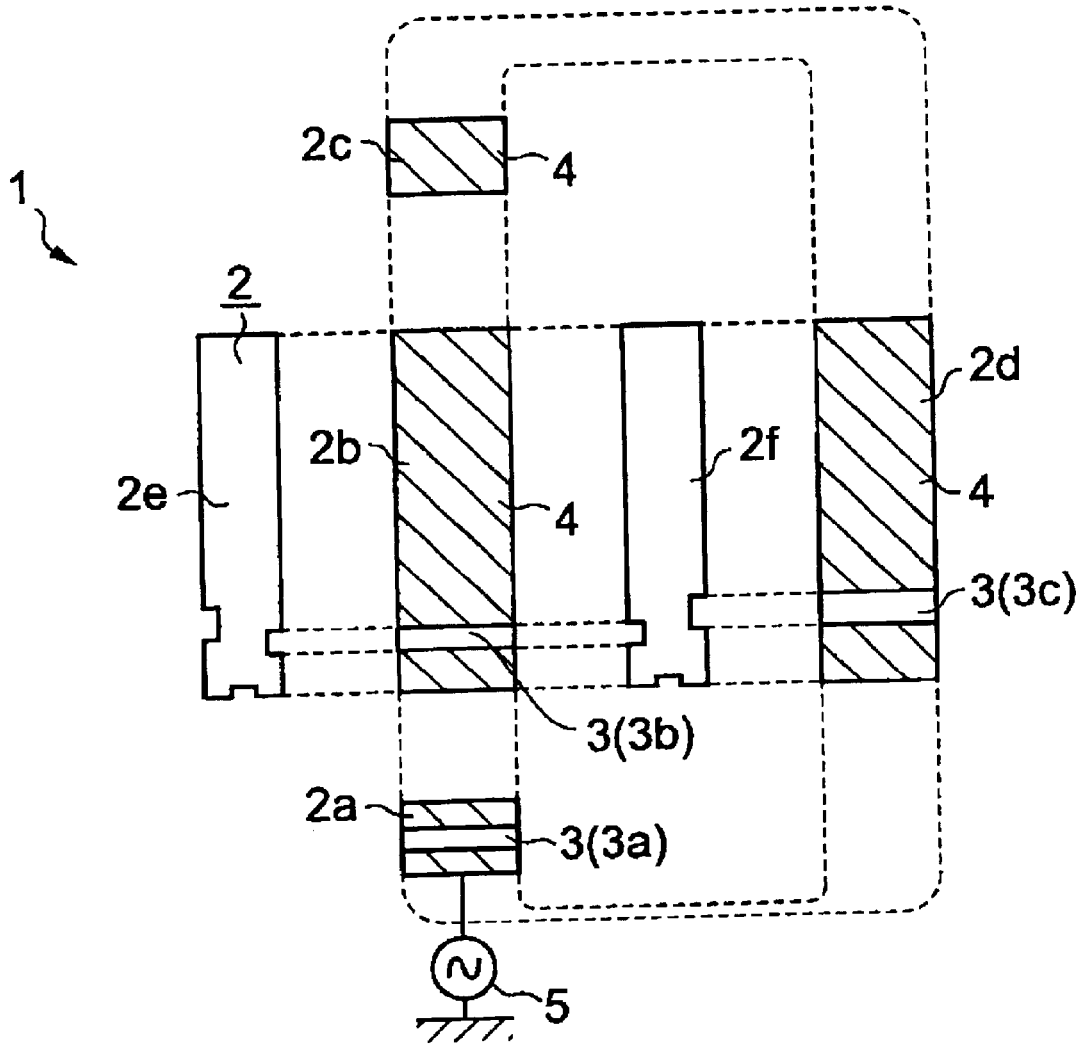
FIG. 5 is a schematic developed view of an example modification of the surface mount antenna of the first preferred embodiment of the present invention.
Figure 6A:
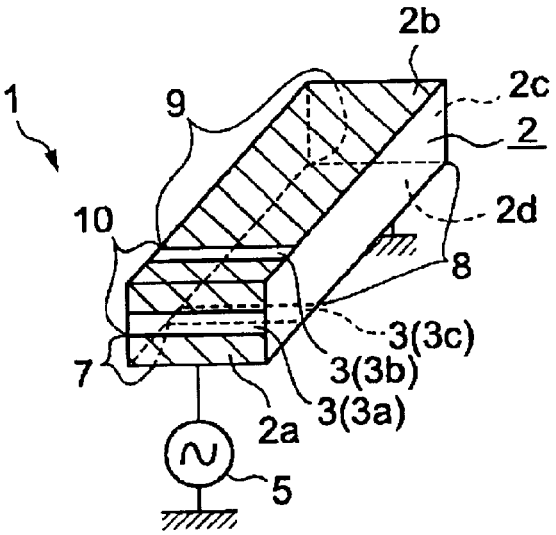
FIG. 6A shows the surface mount antenna shown in FIG. 5 mounted on the circuit substrate of the communication device by the ground mounting method.

FIG. 5 is a developed view of a modified surface mount antenna 1. The conductive film 4 is also formed on the four continuous surfaces, that is, the front end surface 2*a*, the top surface 2*b*, the rear end surface 2*c*, and the bottom surface 2*d*, of the dielectric substrate 2. In this case, the slit 3*a* is formed on the front end surface 2*a*, the slit 3*b* is formed near the front end of the top surface 2*b*, and the slit 3*c* is formed near the front end of the under surface 2*d*.

Where this surface mount antenna 1 shown in FIG. 5 is mounted on the circuit substrate of the communication device, as shown in a perspective view of FIG. 6A, the conductive film part 7 extending from the slit 3*c* on the bottom surface 2*d* to the slit 3*a* on the front end surface 2*a* is connected to the RF circuit 5 disposed on the circuit substrate, and the conductive film part 8 extending from the slit 3*c* to the rear end of the bottom surface 2*d* is connected to the ground of the circuit substrate.

Figure 6B:
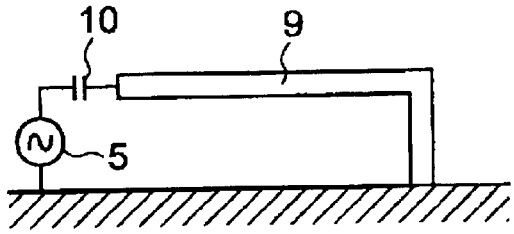
FIG. 6B is an equivalent circuit diagram of the surface mount antenna shown in FIG. 6A.

In this case, the conductive film part 7 functions as a feed-terminal electrode and the conductive film part 8 functions as a ground electrode. The conductive film part 9 extending from the slit 3*b* on the top surface 2*b* to the base end of the rear end surface 2*c* functions as the radiation electrode. The slits 3*a* and 3*b* formed between the feed-terminal electrode 7 and the radiation electrode 9 define the capacitance coupling element 10 for capacitively coupling the feed-terminal electrode 7 to the radiation electrode 9. That is to say, this surface mount antenna 1 is a capacitive-feed surface mount antenna. The radiation electrode 9 functions as λ/4 antenna, as shown in an equivalent circuit diagram of FIG. 6B.

Figure 7A:
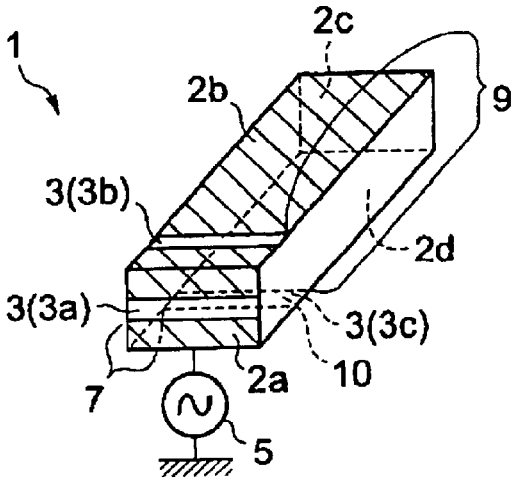
FIG. 7A shows the surface mount antenna shown in FIG. 5 mounted on the circuit substrate by the non-ground mounting method.

FIG. 7A is a perspective view illustrating the surface mount antenna 1 in FIG. 5 mounted on the circuit substrate by the non-ground mounting method. As shown in this drawing, the conductive film part 7 extending from the slit 3*c* formed on the bottom surface 2*d* to the slit 3*a* formed on the front end surface 2*a* is connected to the RF circuit 5. Further, the conductive film part 9 extending from the slit 3*c* to the slit 3*b* on the top surface 2*b* via the rear end surface 2*c* does not come in contact with ground.

Figure 7B:
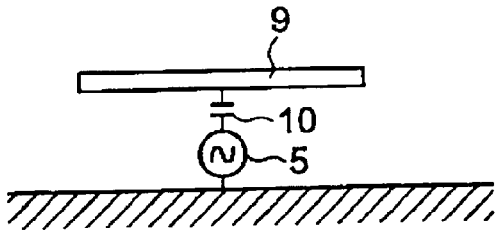
FIG. 7B is an equivalent circuit diagram of the surface mount antenna shown in FIG. 7A.

In this case, the conductive film part 7 functions as a feed-terminal electrode and the conductive film part 9 functions as a radiation electrode. The slit 3*c* formed between the feed-terminal electrode 7 and the radiation electrode 9 functions as the capacitance part 10 for capacitively coupling the feed-terminal electrode 7 to the radiation electrode 9. That is to say, this surface mount antenna 1 also functions as a capacitive-feed surface mount antenna. The radiation electrode 9 functions as a λ/2 antenna, as shown in an equivalent circuit diagram of FIG. 7B.

The positions and widths of the slits 3*a*, 3*b*, and 3*c* of each of the surface mount antennas 1 shown in FIGS. 5 to 7 are determined considering the resonance frequency of the radiation electrode 9 and the impedance matching, as in the case of FIGS. 1 to 3B.

Figure 8:
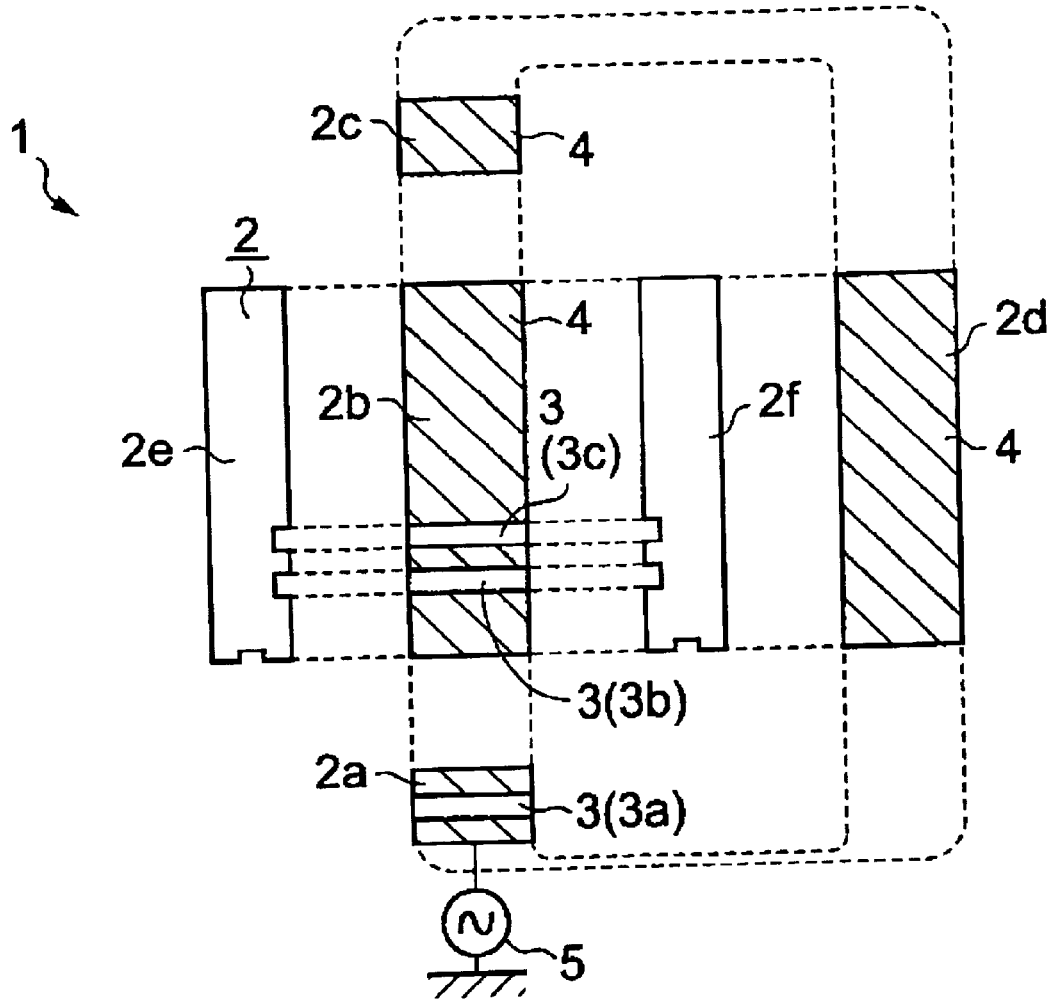
FIG. 8 is a schematic developed view of another example modification of the surface mount antenna of the first preferred embodiment of the present invention.

FIG. 8 is a development view of another modified surface mount antenna 1. The conductive film 4 is also formed on the four continuous surfaces, that is, the front end surface 2*a*, the top surface 2*b*, the rear end surface 2*c*, and the bottom surface 2*d*, of the dielectric substrate 2. In this case, the slit 3*a* is formed on the front end surface 2*a* and the slits 3*b* and 3*c* are formed near the front end of the top surface 2*b* with a predetermined gap therebetween.

Figure 9A:
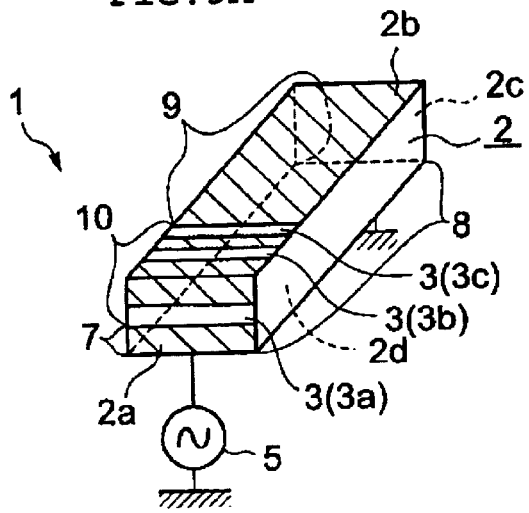
FIG. 9A shows the surface mount antenna shown in FIG. 8 mounted on the circuit substrate of the communication device by the ground mounting method.

When this surface mount antenna 1 shown in FIG. 8 is mounted on the circuit substrate of the communication device, as shown in a perspective view of FIG. 9A, the conductive film part 7 extending from the slit 3*a* on the front end surface 2*a* to the base end of the front end surface 2*a* functions as a feed-terminal electrode. The conductive film part 8 covering the entire surface of the bottom surface 2*d* functions as a ground electrode. Further, the conductive film part 9 extending from the slit 3*c* on the top surface 2*b* to the base end of the rear end surface 2*c* functions as a radiation electrode. The slits 3*a*, 3*b*, and 3*c* provided between the feed-terminal electrode 7 and the radiation electrode 9 define the capacitance coupling element 10 for capacitively coupling the feed-terminal electrode 7 and the radiation electrode 9.

Figure 9B:
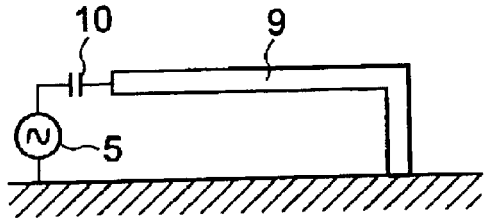
FIG. 9B is an equivalent circuit diagram of the surface mount antenna shown in FIG. 9A.

In this case, one end of the radiation electrode 9 is connected to the RF circuit 5 via the capacitance coupling element 10 and the other end thereof is connected to ground, as shown in an equivalent circuit diagram of FIG. 9B. This radiation electrode 9 functions as a λ/4 antenna.

Figure 10A:
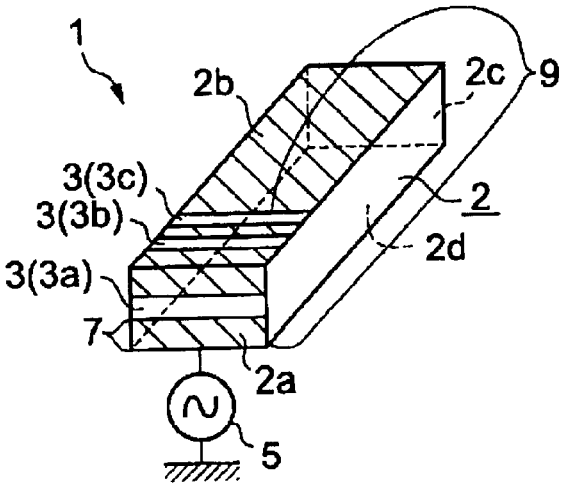
FIG. 10A shows the surface mount antenna shown in FIG. 8 mounted on the circuit substrate by the non-ground mounting method.

FIG. 10A is a perspective view of the surface mount antenna 1 of FIG. 8, the surface mount antenna 1 being mounted on the circuit substrate by the non-ground mounting method. In this case, the conductive film part 7 extending from the slit 3*a* on the front end surface 2*a* to the base end of the front end surface 2*a* functions as a feed-terminal electrode. Further, the conductive film part 9 extending from the front end of the bottom surface 2*d* to the slit 3*c* on the top surface 2*b* via the rear end surface 2*c* functions as a radiation electrode. More specifically, the conductive film part 7 formed on the front end surface 2*a*, the conductive film part 7 being part of the conductive film 4 extending from the slit 3*a* to the slit 3*c* via the rear end surface 2*c*, functions as a feed-terminal electrode. Further, the other part of the conductive film 4, that is, the conductive film part 9, functions as a radiation electrode. The feed-terminal electrode 7 and the radiation electrode 9 are arranged so as to be adjacent to each other.

Figure 10B:
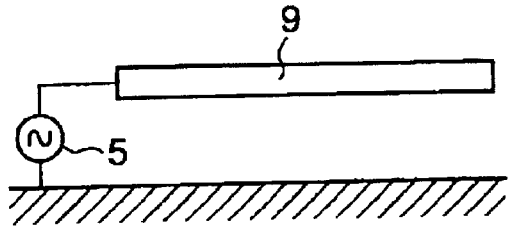
FIG. 10B is an equivalent circuit diagram of the surface mount antenna shown in FIG. 10A.

In this case, the surface mount antenna 1 functions as a direct-feed surface mount antenna. The slits 3*a*, 3*b*, and 3*c* are provided between one end of the feed terminal electrode 7 and one end of the radiation electrode 9. One of these slits, that is, the slit 3*a*, forms an open end of the feed terminal electrode 7 and another slit, that is, the slit 3*c*, forms an open end of the radiation electrode 9. That is to say, one end of the radiation electrode 9 is directly connected to the RF circuit 5 and the other end thereof forms the open end, as shown in an equivalent circuit diagram of FIG. 10B. This radiation electrode 9 functions as a λ/4 antenna. Since the position of the end of the radiation electrode 9 near the feed-terminal electrode 7 is fixed, the resonance frequency of the radiation electrode 9 is controlled by changing the position of the slit 3*c*, which forms the open end of the radiation electrode 9.

Figure 11:
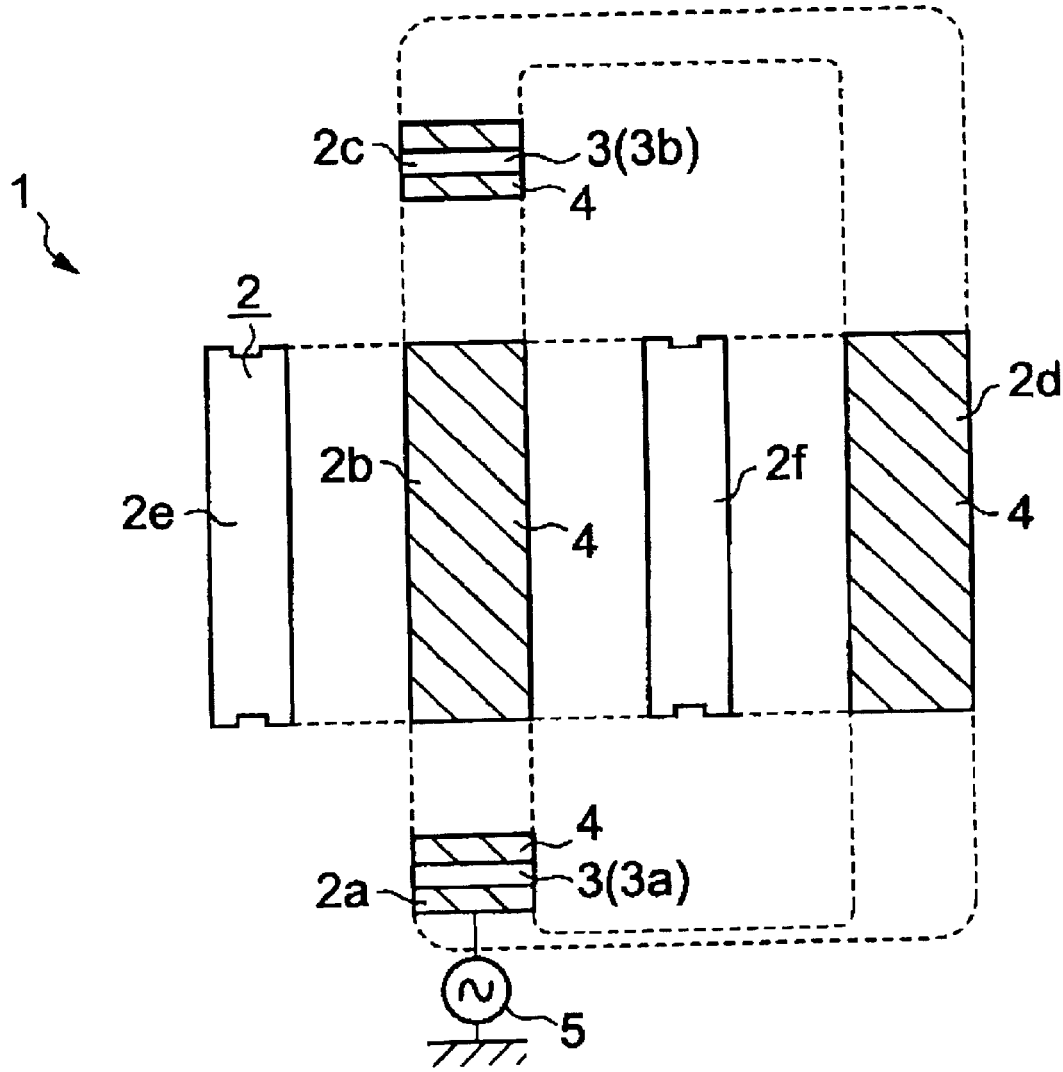
FIG. 11 is a schematic developed view of another example modification of the surface mount antenna of the first preferred embodiment of the present invention.

A plurality of slits, such as the slits 3*a* and 3*b*, can be formed on the conductive film 4, as shown in a developed view of FIG. 11. In this case, the slit 3*a* and the slit 3*b* are formed on the front end surface 2*a* and the rear end surface 2*c*, respectively.

Figure 12A:
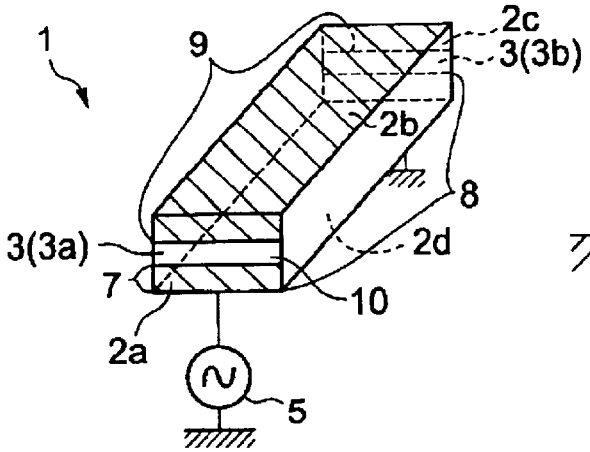
FIG. 12A shows the surface mount antenna shown in FIG. 11 mounted on the circuit substrate of the communication device by the ground mounting method.

FIG. 12A is a perspective view of this surface mount antenna 1 shown in FIG. 11, the surface mount antenna 1 being mounted on the circuit substrate by the ground-mounting method. In this case, the conductive film part 7 extending from the slit 3*a* on the front end surface 2*a* to the base end of the front end surface 2*a* functions as a feed-terminal electrode. The conductive film part 8 extending from the bottom surface 2*d* to the slit 3*b* on the rear end surface 2*c* bordering the bottom surface 2*d* functions as a ground electrode. The conductive film part 9 extending from the slit 3*a* to the slit 3*b* via the top surface 2*b* functions as a radiation electrode. The slit 3*a* provided between the feed-terminal electrode 7 and the radiation electrode 9 forms the capacitance coupling element 10 for capacitively coupling the feed-terminal electrode 7 to the radiation electrode 9. This surface mount antenna 1 functions as a capacitive-feed surface mount antenna.

Figure 12B:
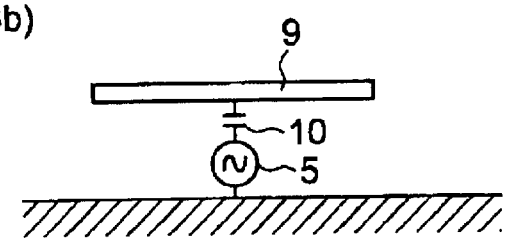
FIG. 12B is an equivalent circuit diagram of the surface mount antenna shown in FIG. 12A.

FIG. 12B is an equivalent circuit diagram illustrating the surface mount antenna 1 of FIG. 12A. In this drawing, the radiation electrode 9, having two open ends, is connected to the RF circuit 5 via the capacitance coupling element 10. This radiation electrode 9 functions as a $\lambda/2$ antenna. The positions of the slits 3*a* and 3*b* provided on both sides of the radiation electrode 9 are determined so that the radiation electrode 9 can generate a predetermined resonance frequency. Further, the width of each of these slits 3*a* and 3*b* is determined so as to obtain a predetermined ratio between the capacitances Ca and Cb generated by the slits 3*a* and 3*b*, that is, the predetermined ratio suitable for matching the impedance of the radiation electrode 9 to that of the RF circuit 5.

Figure 13A:
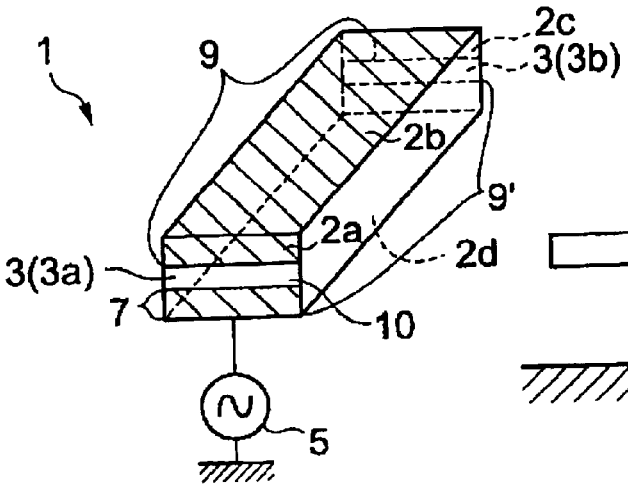
FIG. 13A shows the surface mount antenna shown in FIG. 11 mounted on the circuit substrate of the communication device by the non-ground mounting method.

FIG. 13A is a perspective view of the surface mount antenna 1 of FIG. 11, the surface mount antenna 1 being mounted on the circuit substrate by the non-ground mounting method. In this case, the conductive film part 7 extending from the slit 3*a* on the front end surface 2*a* to the base end of the front end surface 2*a* functions as a feed-terminal electrode. The conductive film part 9 extending from the slit 3*a* to the slit 3*b* via the top surface 2*b* functions as a capacitive-feed radiation electrode. A conductive film part 9' extending from the bottom surface 2*d* to the slit 3*b* on the rear end surface 2*c* bordering the bottom surface 2*d* functions as a direct-feed radiation electrode. The slit 3*a* provided between the feed-terminal electrode 7 and the capacitive-feed radiation electrode 9 defines the capacitance coupling element 10 for capacitively coupling the feed-terminal electrode 7 to the capacitive-feed radiation electrode 9.

Figure 13B:
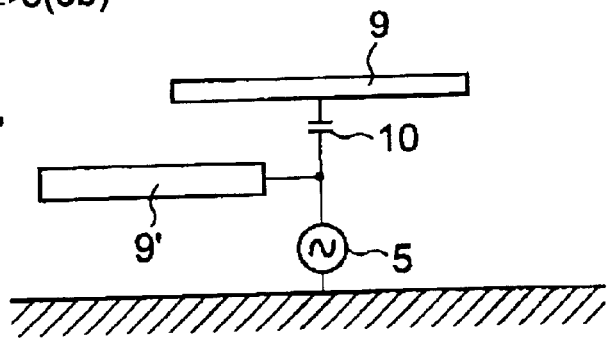
FIG. 13B is an equivalent circuit diagram of the surface mount antenna shown in FIG. 13A.

That is to say, the two radiation electrodes of different power-feeding types, that is, the capacitive-feed radiation electrode 9 and the direct-feed radiation electrode 9' are formed on the dielectric substrate 2 shown in FIG. 13A. As shown in an equivalent circuit diagram of FIG. 13B, the capacitive-feed radiation electrode 9 has two open ends and functions as a $\lambda/2$ antenna. The direct-feed radiation electrode 9' functions as a $\lambda/4$ antenna.

As has been described, the surface mount antenna 1 can be changed in various ways by changing the number and the widths of the slits, and the gaps between the slits. The resonance frequency of the radiation electrode 9 of each of the surface mount antennas 1 shown in FIGS. 5 to 13B can be controlled by adjusting the positions of the slits 3*a*, 3*b*, and 3*c*, as in the case of the surface mount antenna 1 shown in FIG. 1. Where the capacitive-feed surface mount antenna 1 is used, the impedance of the radiation electrode 9 can be matched to that of the RF circuit 5 by adjusting the widths of the slits, that is, the capacitances of the slits.

In the first preferred embodiment, the width d of each of the slits is preferably determined to range from about 1/2000 to about ¾ of the thickness of the surface mount antenna 1, the thickness being indicated by D ($(D/2000) \leqq d \leqq (3 \cdot D/4)$). However, the width d may be determined without being limited to the above-described preferred embodiment.

Figure 14:
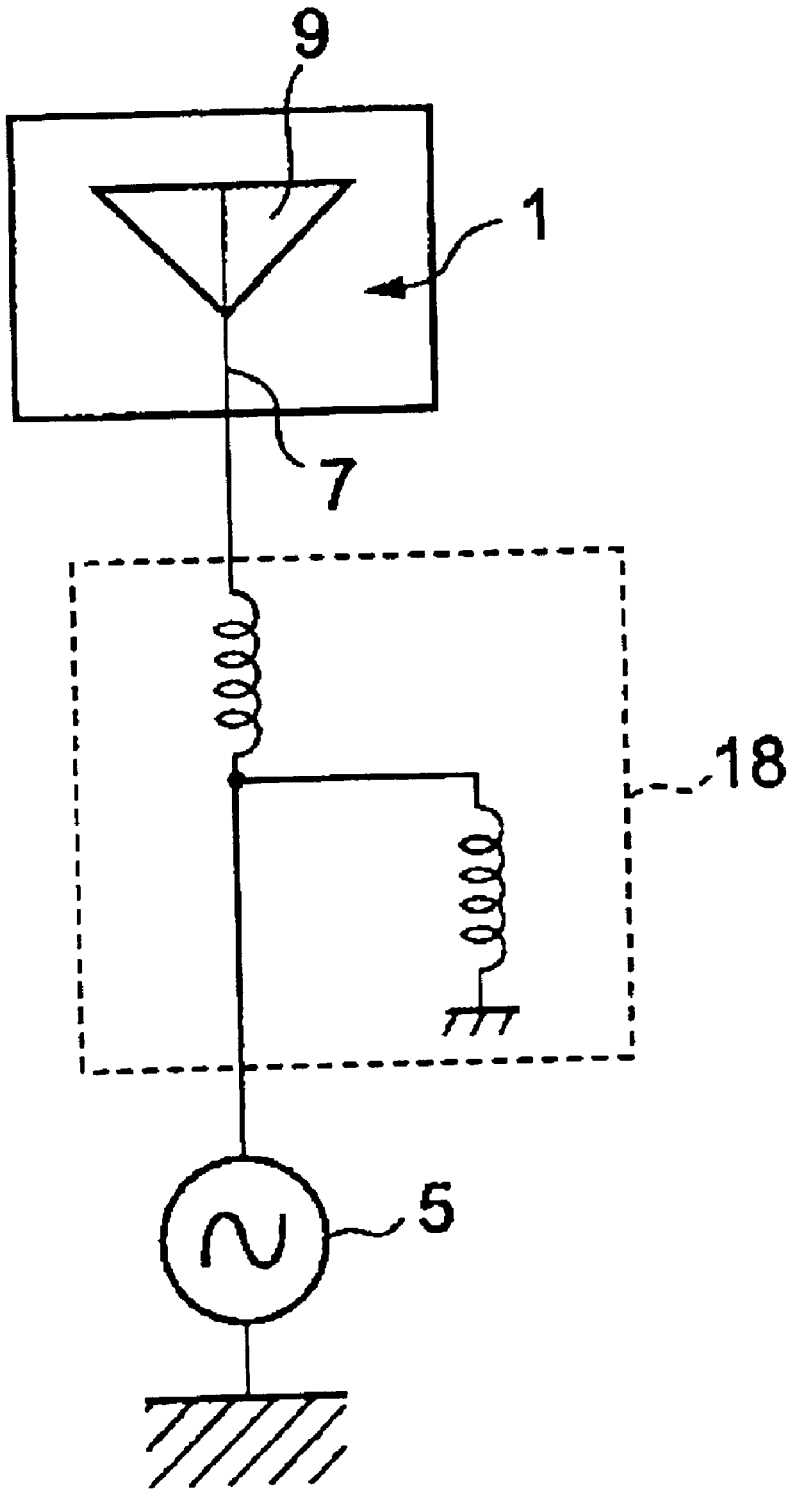
FIG. 14 schematically shows an example where the surface mount antenna is connected to a circuit of the communication device.

Further, in the first preferred embodiment, the sum of the widths of the slits 3*a*, 3*b*, and 3*c* is referred to as the slit width H. The slit width H preferably ranges from about 1/1000 to about ¾ of the effective length L of the radiation electrode 9. That is to say, the ratio between the effective length L and the slit width H is $(1/1000) \leqq (H/L) \leqq (3/4)$. However, the slit width H can be determined without being limited to the above-described preferred embodiment.

Where the capacitive-feed radiation electrode 9 is used, the impedance of the radiation electrode 9 can be easily matched to that of the RF circuit 5 by adjusting the balance between or among the capacitances generated by the slits formed on the conductive film 4. Since the surface mount antenna 1 can achieve the impedance matching by itself, the feed-terminal electrode 7 and the RF circuit can be directly connected to each other without fear of an impedance mismatch, which eliminates the need for providing an impedance-matching circuit between the surface mount antenna 1 and the RF circuit 5. Subsequently, the circuit configuration of the communication device is simplified.

Where the direct-feed radiation electrode 9 is used, the impedance of the radiation electrode 9 is so high that there is a possibility that the impedance mismatch will occur. In this case, it is not possible to directly connect the surface mount antenna 1 to the RF circuit 5. Therefore, a matching circuit 18 for matching the impedance of the surface mount antenna 1 to that of the RF circuit 5 is provided on a signal-flow path extending from the surface mount antenna 1 to the RF circuit 5, as shown in FIG. 14. In this drawing, the matching circuit 18 preferably includes two inductor coils, such as two chip coils. However, the configuration of the matching circuit 18 may vary without being limited to the above-described example shown in FIG. 14, so long as the matching circuit 18 is ready for the impedance mismatch between the surface mount antenna 1 and the RF circuit 5.

A second preferred embodiment of the present invention will now be described. It is to be noted that same parts as those of the first preferred embodiment are designated by the same reference numerals and the description thereof is omitted.

The surface mount antenna 1 of this preferred embodiment has the slits 3*a*, 3*b*, and 3*c* on at least two of the conductive film parts on the front end surface 2*a*, the top surface 2*b*, the rear end surface 2*c*, and the bottom surface 2*d*.

In this preferred embodiment, at least one of the slits 3*a*, 3*b*, and 3*c*, the slit being formed on at least one of the conductive film parts on the four continuous surfaces, is formed preferably by using the dicer. However, the other slits are formed by using another technology such as etching, thick-film pattern printing, or other suitable process, and so forth.

More specifically, where the slits 3*a* and 3*b* are formed on the top surface 2*b* and the slit 3*c* is formed on the bottom surface 2*d*, as shown in FIG. 1, the slit 3*c* is not formed by using the dicer, but the etching, the thick-film pattern printing, or other suitable process, and so forth. The slits 3*a* and 3*b* on the top surface 2*b* are preferably formed by using the dicer.

An example procedure for manufacturing the surface mount antenna 1 of this preferred embodiment will now be described with reference to FIGS. 15A, 15B, 15C, 15D, and 15E.

Figure 15A:
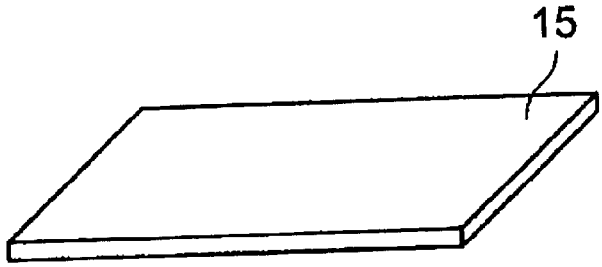
FIG. 15A shows an example procedure of manufacturing the surface mount antenna according to a second preferred embodiment of the present invention.
Figure 15B:
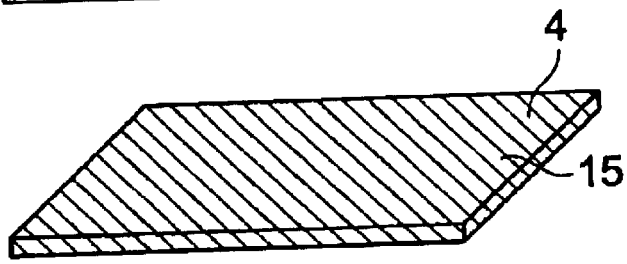
FIG. 15B shows another example procedure of manufacturing the surface mount antenna according to the second preferred embodiment of the present invention.
Figure 15C:
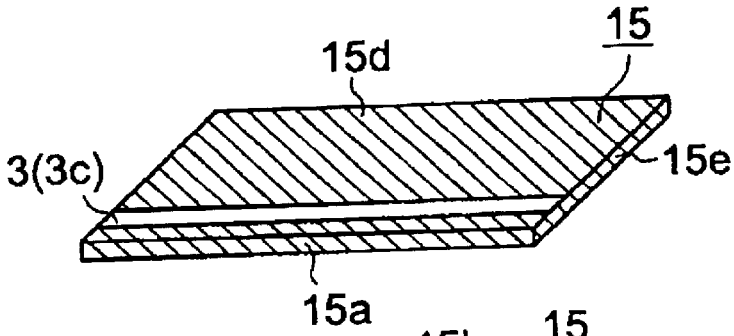
FIG. 15C shows another example procedure of manufacturing the surface mount antenna according to the second preferred embodiment of the present invention.

First, the dielectric base 15 is prepared, as in the first preferred embodiment, as shown in FIG. 15A. Then, the conductive film 4 is formed on the entire surface of the dielectric base 15, as shown in FIG. 15B.

Then, the slit 3*c* is formed on the bottom surface 15*d* without using the dicer. This slit 3*c* is formed by the etching, thick-film pattern printing, or other suitable process, and so forth, for example.

Figure 15D:
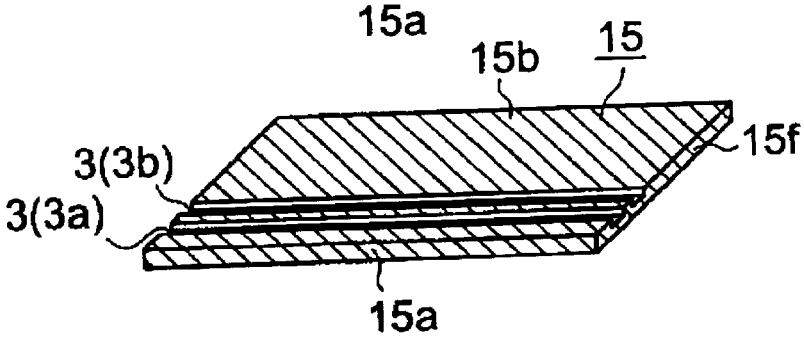
FIG. 15D shows another example procedure of manufacturing the surface mount antenna according to the second preferred embodiment of the present invention.

Then, the dielectric base 15 is reversed and the slits 3A and 3B are formed at predetermined positions on the top surface 15*b* by using the dicer, as shown in FIG. 15D.

Figure 15E:
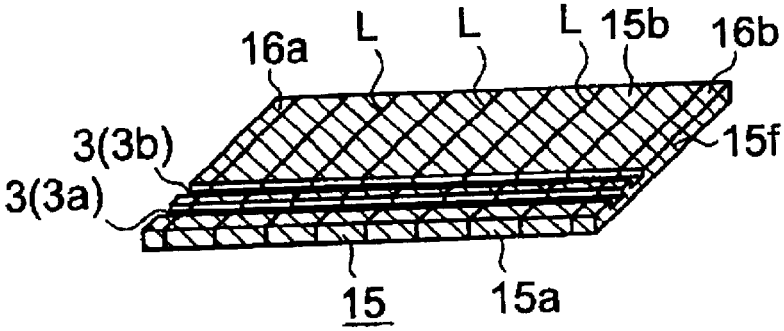
FIG. 15E shows another example procedure of manufacturing the surface mount antenna according to the second preferred embodiment of the present invention.

Further, as in the first preferred embodiment, the dielectric base 15 is cut and divided into a plurality of pieces along the predetermined cut lines L. Subsequently, a plurality of the surface mount antennas 1 is formed at the same time, as shown in FIG. 15E.

It is very difficult to mount the dielectric base 15 on the dicer so that the dicer can cut the dielectric base 15. In particular, where the slits 3*a*, 3*b*, and 3*c* are formed on at least two of the four continuous surfaces 2*a*, 2*b*, 2*c*, and 2*d* of the dielectric substrate 2, the dielectric base 15 must be remounted on the dicer every time the dicer finishes cutting one surface and becomes ready for the next cutting so that the dielectric base 15 is placed with a predetermined surface facing upwardly, the predetermined surface being subjected to the next cutting. That is to say, where all the slits are formed by using the dicer, the dielectric base 15 must be remounted on the dicer a plurality of times, which requires much trouble and time.

Figure 2B:
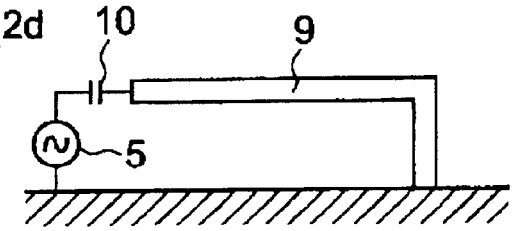
FIG. 2B is an equivalent circuit diagram of the surface mount antenna shown in FIG. 2A.

In the second preferred embodiment, however, the at least one slit on at least one of the four continuous surfaces is formed without using the dicer. Therefore, the number of times the dielectric base 15 is mounted on the dicer is greatly reduced.

Where the surface mount antenna 1 shown in FIGS. 2A and 2*b* is formed according to this preferred embodiment, the slits 3*a* and 3*b* on the top surface 2*b* is preferably formed by using the dicer and the slit 3*c* is preferably formed by etching, thick-film pattern printing, or other suitable process, and so forth. The slit 3*c* is formed by the etching, the thick-film pattern printing, or other suitable process, and so forth, with precision that is slightly lower than that in the case of the slits 3*a* and 3*b* formed by using the dicer. Since the slit 3*b*, which affects the resonance frequency of the radiation electrode 9, is formed with high precision by using the dicer, it becomes possible to make the radiation electrode 9 generate a predetermined resonance frequency with high precision. Further, since the slit 3*c*, which hardly affects the resonance frequency of the radiation electrode 9, is formed without using the dicer, it becomes possible to reduce the number of steps of mounting the dielectric base 15 on the dicer.

Thus, according to this preferred embodiment, at least the slits affecting the resonance frequency of the radiation electrode 9 are formed by using the dicer, and the other slit is formed by using other methods in place of the dicer. Therefore, the number of required steps for mounting the dielectric base 15 on the dicer is greatly reduced and substantially the desired resonance frequency can be generated by the radiation electrode 9.

The configuration and manufacturing steps of the surface mount antenna 1 of this preferred embodiment are applicable to the cases where the slits are formed as shown in FIGS. 5 to 13B.

A third preferred embodiment of the present invention will now be described. This preferred embodiment relates to the above-described communication device. This communication device includes either the surface mount antenna 1 of the first preferred embodiment or that of the second preferred embodiment. Since the configuration of this communication device may vary, the description thereof is omitted. When the surface mount antenna 1 is directly connected to the RF circuit 5 and the impedance of the surface mount antenna 1 does not match to that of the RF circuit 5, the matching circuit 18 for achieving the impedance matching is formed on the signal-flow path between the surface mount antenna 1 and the RF circuit 5 at a predetermined position on the circuit substrate of the communication device.

The present invention is not limited to the above-described first to third preferred embodiments but can be achieved in various forms. In the first and second preferred embodiments, for example, the conductive film 4 is preferably formed on the entire surface of the dielectric base 15. However, where no conductive film 4 is needed on the side surfaces of the dielectric base 15, the conductive film 4 should be formed only on the four continuous surfaces, that is, the front end surface, the top surface, the rear end surface, and the bottom surface by using the thick-film pattern printing method, for example. This method eliminates the steps of removing the end portions 16*a* and 16*b* only for forming parts where no conductive film 4 is formed thereon. Since the end portions 16*a* and 16*b* can be used effectively, the wasted space is eliminated.

Further, where the dicer is used for forming the slits in the first and second preferred embodiments, the dicer forms the slits so that each of the slits runs a predetermined length and has a predetermined width. However, the slit may be formed so that it runs a length that is a little shorter than the predetermined length by etching, thick-film pattern printing, or other suitable process, and so forth. After that, both ends of the slit may be cut by the dicer so that the slit runs the predetermined length and has the predetermined width.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

What is claimed is:

1. A surface mount antenna functioning as a capacitive-feed surface mount antenna including a radiation electrode and a feed-terminal electrode, the surface mount antenna comprising:

a substrate having four continuous surfaces including a front end surface, a top surface, a rear end surface, and a bottom surface; and a conductive film provided on the four continuous surfaces of the substrate; wherein a plurality of spaced-apart slits is formed in the conductive film, the plurality of slits extending across a width of the substrate in a predetermined direction crossing the direction in which the four continuous surfaces surround the substrate and dividing the conductive film into a plurality of conductive film parts;

one of the plurality of conductive film parts defines the radiation electrode, which operates as an antenna, and one of the other conductive film parts defines the feed-terminal electrode, which is capacitively coupled to the radiation electrode;

at least one of the plurality of slits is formed between the radiation electrode and the feed-terminal electrode and defines a capacitance coupling element for capacitively coupling the radiation electrode to the feed-terminal electrode;

a ratio that is at least one of between and among capacitances generated by the plurality of slits is used to match a first impedance of the radiation electrode to a second impedance of the feed-terminal electrode; and the at least one slit forming the capacitance coupling element defines an open end of the radiation electrode and sides of the slit forming the open end are formed by using a dicer.

2. A surface mount antenna according to claim 1, wherein a width of each of the plurality of slits is substantially the same as a width of the substrate.

3. A surface mount antenna according to claim 1, wherein at least one of the plurality of slits is formed on the top surface of the substrate and at least one of the plurality of slits is formed on the bottom surface of the substrate.

4. A surface mount antenna according to claim 1, wherein a depth of each of the plurality of slits is about 1/2000 to about 3/4 of the thickness of the surface mount antenna.

5. A surface mount antenna according to claim 1, wherein at least two of the plurality of slits have difference depths.

6. A surface mount antenna according to claim 1, wherein a capacitance is generated by each of the plurality of slits.

7. A surface mount antenna according to claim 1, wherein the radiation electrode has two open ends and functions as a $\lambda/2$ antenna.

8. A surface mount antenna according to claim 1, wherein the feed-terminal electrode functions as a $\lambda/4$ antenna.

9. A communication device comprising a surface mount antenna according to claim 1.

10. A communication device according to claim 9, wherein the surface mount antenna is mounted on a circuit substrate of the communication device and connected to a circuit disposed on the circuit substrate, and wherein the communication device includes a matching circuit on a signal-flow path extending from the surface mount antenna to the circuit so as to match impedance of the surface mount antenna to that of the circuit.

11. A surface mount antenna functioning as a direct-feed surface mount antenna including a radiation electrode and a feed-terminal electrode, the surface mount antenna comprising:

a substrate having four continuous surfaces including a front end surface, a top surface, a rear end surface, and a bottom surface; and a conductive film provided on the four continuous surfaces of the substrate; wherein a plurality of spaced-apart slits is formed in the conductive film, the plurality of slits extending across a width of the substrate in a predetermined direction crossing the direction in which the four continuous surfaces surround the substrate and dividing the conductive film into a plurality of conductive film parts;

one end of one of the conductive film parts defines the feed-terminal electrode and the other end thereof defines the radiation electrode, which operates as an antenna, and wherein the feed-terminal electrode and the radiation electrode are arranged so as to be adjacent to each other;

at least two of the plurality of slits are formed between the end defining the feed-terminal electrode and the other end defining the radiation electrode, and an open end of the radiation electrode is defined by sides of one of the plurality of slits, the sides being formed by using a dicer.

12. A surface mount antenna according to claim 11, wherein a width of each of the plurality of slits is substantially the same as a width of the substrate.

13. A surface mount antenna according to claim 11, wherein at least one of the plurality of slits is formed on the top surface of the substrate and at least one of the plurality of slits is formed on the bottom surface of the substrate.

14. A surface mount antenna according to claim 11, wherein a depth of each of the plurality of slits is about 1/2000 to about 3/4 of the thickness of the surface mount antenna.

15. A surface mount antenna according to claim 11, wherein at least two of the plurality of slits have difference depths.

16. A surface mount antenna according to claim 11, wherein a capacitance is generated by each of the plurality of slits.

17. A surface mount antenna according to claim 11, wherein the radiation electrode has two open ends and functions as a $\lambda/2$ antenna.

18. A surface mount antenna according to claim 11, wherein the feed-terminal electrode functions as a $\lambda/4$ antenna.

19. A communication device comprising a surface mount antenna according to claim 11.

20. A communication device according to claim 19, wherein the surface mount antenna is mounted on a circuit substrate of the communication device and connected to a circuit disposed on the circuit substrate, and wherein the communication device includes a matching circuit on a signal-flow path extending from the surface mount antenna to the circuit so as to match impedance of the surface mount antenna to that of the circuit.

21. A surface mount antenna comprising:

a substrate having four continuous surfaces including a front end surface, a top surface, a rear end surface, and a bottom surface; and a conductive film provided on the four continuous surfaces of the substrate; wherein a plurality of spaced-apart slits formed in the conductive film, the plurality of slits extending across a width of the substrate in a predetermined direction crossing the direction in which the four continuous surfaces surround the substrate and dividing the conductive film into a plurality of conductive film parts;

one end of one of the conductive film parts defines a feed-terminal electrode connected to an external circuit and the other end thereof defines a direct-feed radiation electrode operating as an antenna adjacent to the feed-terminal electrode;

a conductive film part adjacent to the feed-terminal electrode via at least one of the slits defines a capacitive-feed radiation electrode;

the at least one slit between the feed-terminal electrode and the capacitive-feed radiation electrode defines a capacitance coupling element for capacitively coupling the feed-terminal electrode to the capacitive-feed radiation electrode;

the at least one slit defining the capacitance coupling element defines a first open end of the capacitive-feed radiation electrode and sides of the slit forming the first open end are formed by using a dicer; and one of the plurality of slits defines a second open end of the direct-feed radiation electrode and sides of the slit forming the second open end are formed by using the dicer.

22. A surface mount antenna according to claim 21, wherein a width of each of the plurality of slits is substantially the same as a width of the substrate.

23. A surface mount antenna according to claim 21, wherein at least one of the plurality of slits is formed on the top surface of the substrate and at least one of the plurality of slits is formed on the bottom surface of the substrate.

24. A surface mount antenna according to claim 21, wherein a depth of each of the plurality of slits is about 1/2000 to about 3/4 of the thickness of the surface mount antenna.

25. A surface mount antenna according to claim 21, wherein at least two of the plurality of slits have difference depths.

26. A surface mount antenna according to claim 21, wherein a capacitance is generated by each of the plurality of slits.

27. A surface mount antenna according to claim 21, wherein the radiation electrode has two open ends and functions as a $\lambda/2$ antenna.

28. A surface mount antenna according to claim 21, wherein the feed-terminal electrode functions as a $\lambda/4$ antenna.

29. A communication device comprising a surface mount antenna according to claim 21.

30. A communication device according to claim 29, wherein the surface mount antenna is mounted on a circuit substrate of the communication device and connected to a circuit disposed on the circuit substrate, and wherein the communication device includes a matching circuit on a signal-flow path extending from the surface mount antenna to the circuit so as to match impedance of the surface mount antenna to that of the circuit.

31. A method of manufacturing a surface mount antenna including at least one radiation electrode and at least one feed-terminal electrode that are formed of a conductive film and that are formed on a substrate, the method comprising the steps of:

forming the conductive film on four continuous surfaces of a base, the four continuous surfaces including a top surface, a bottom surface, and two end surfaces facing each other;

forming a plurality of slits in the conductive film by cutting the conductive film by using a dicer so that the slits extend in a direction crossing the direction in which the conductive film surrounds the base; and dividing the base along the surrounding direction into a plurality of pieces so as to form a plurality of the surface mount antennas.

32. A method of manufacturing a surface mount antenna including at least one radiation electrode and at least one feed-terminal electrode that are formed of conductive film parts and that are formed on a substrate, the method comprising the steps of:

forming the conductive film parts on each of four continuous surfaces of a base, the four continuous surfaces including a top surface, a bottom surface, and two end surfaces facing each other;

forming a plurality of slits in the conductive film parts so that the slits extend in a direction crossing the direction in which the conductive film parts surround the base; and dividing the base along the surrounding direction into a plurality of pieces so as to form a plurality of the surface mount antennas; wherein the plurality of slits is formed on at least two of the four conductive film parts, and at least one of the slits is formed on at least one of the four conductive film parts by a predetermined slit-forming method without using a dicer and the other slits are formed on the other conductive film parts by using the dicer.

* * * * *